United States Patent [19]

Burgess

[11] Patent Number: 5,042,296

[45] Date of Patent: Aug. 27, 1991

[54] METHOD OF IN-SITU TESTING OF A DRILLING FLUID

[75] Inventor: Trevor M. Burgess, Missouri City, Tex.

[73] Assignee: Schlumberger Technology Corporation, Houston, Tex.

[21] Appl. No.: 626,492

[22] Filed: Dec. 12, 1990

[30] Foreign Application Priority Data

Dec. 26, 1989 [FR] France ..... 89 17294

[51] Int. Cl.[5] ..... E21B 47/06

[52] U.S. Cl. ..... 73/153; 73/64.1

[58] Field of Search ..... 73/153, 61.4, 64.1; 175/48

[56] References Cited

U.S. PATENT DOCUMENTS

| | | | |
|---|---|---|---|
| 4,274,283 | 6/1981 | Maus et al. | 73/153 |
| 4,341,115 | 7/1982 | Alekhin et al. | 73/153 |
| 4,694,692 | 9/1987 | Brown et al. | 73/155 |
| 4,726,219 | 2/1988 | Pearson et al. | 73/53 |
| 4,879,654 | 11/1989 | Bruce | 364/422 |

FOREIGN PATENT DOCUMENTS

| | | |
|---|---|---|
| 2493927 | 5/1982 | France . |
| 1280227 | 7/1972 | United Kingdom . |

OTHER PUBLICATIONS

P. Parigot, "Surface Recorder Can Signal Downhole Drilling Problem", *World Oil 201*, No. 6, pp. 71-79, Nov. 1985.

*Primary Examiner*—Jerry W. Myracle

*Attorney, Agent, or Firm*—Martin Hyden; John J. Ryberg

[57] ABSTRACT

The method comprises during a drilling operation wherein the drilling fluid is set moving and the drill string is stationary, monitoring the pressure of the drilling fluid pumped into the drill string depending on the volume of liquid pumped in the drill string and determining, from the pressure curve, a physical property linked to the thixotropy of the drilling fluid. An advantage of the invention is that the highest point of the pressure curve indicating the start of the fluid flow into the well is easily visible, and its maximum value can be measured to find the gel strength specific value.

13 Claims, 6 Drawing Sheets

METHOD OF IN-SITU TESTING OF A DRILLING FLUID

This invention relates to a method of in situ testing of a thixotropic drilling fluid during drilling of a well using a drilling tool with a drill bit and drill string formed from drill pipes joined together.

In the rotary drilling of an oil or geothermal well, a drill string is formed from a set of pipes joined together and a drill bit fitted at one end. The drill bit drills the rock when it starts rotating, either by rotating the drill string from the surface, or by using a hydraulic motor situated above the drill bit. A drilling fluid, normally called "mud" is pumped from the surface inside the drill string, goes through the drill bit and comes back to the surface through the annulus existing between the wall of the well and the drill string. Mud is an important part of the drilling process and is used for several purposes. One of them is to create hydrostatic pressure on the drill bit sufficient to counterbalance the pressure of the fluids present in the rocks which are being drilled. This hydrostatic pressure cannot be too high so as not to fracture the rock. The density of the mud must be maintained between minimum and maximum values. Another function of the mud is to bring back to the surface the rock cuttings which have just been drilled. For this the mud viscosity must be sufficient to keep the cuttings suspended. However, viscosity cannot be too high to prevent pumping and circulating of the drilling fluid in the well. In use, the drilling fluid is either stationary and has a tendency to gel or is circulated by means of a pump from the surface to the inside of the drill string and rises towards the surface in the annulus between the wall of the drilled well and the drill string assembly.

Every time drilling progresses in depth by one drill pipe length, fluid circulation must be stopped while another pipe is added to the drill string. During this operation the drilling fluid which is stationary in the well contains the cuttings that the fluid is bringing to the surface. To prevent these cuttings from going back to the bottom of the well a thixotropic fluid is used. The rheological properties of the mud are affected by the drilling conditions such as temperature in the well and the types of rocks drilled. As an example, when drilling a clay formation, the clay dissolves in the fluid increasng greatly the mud viscosity and the yield stress. It is therefore essential to test and control the drilling fluid properties so as to be able to modify its formula to maintain a chosen formula or modify it depending on the drilling conditions.

Normal practice on drilling sites is to take a sample of mud regularly and test its rheological properties, especially its viscosity. However these test conditions are not equivalent to the conditions prevailing in the well and do not reflect the state of the mud being used. This method is described in U.S. Pat. No. 4,726,219 and GB patent 1280,227. A method of in situ testing of the rheological properties of drilling fluids is described in the article "Surface recorder can signal downhole drilling problems" in World Oil (November 85 p71-77). However the rheological properties of a drilling fluid can only be tested when the mud is circulating.

This invention proposes a method of in situ testing of the drilling fluid which avoids the drawbacks of previous methods. To be more precise, this invention provides a test method for a thixotropic drilling fluid during drilling operations carried out with a drilling tool including a drill bit, a drill string assembly formed from drilling pipes joined together. The drilling fluid when stationary has a tendency to gel or the drilling fluid is being circulated by means of a pump from the surface to the drill bit inside the drill string and rising towards the surface in the annular space provided between the wall of the well already drilled and the drill string. When the circulation is restarted, the drilling tool is stationary; the evolution in the pressure of the fluid being pumped in the drilling tool can be monitored. One aspect of the invention is to be able to monitor the pressure peak corresponding to the start-up of fluid circulation in the well and to measure its maximum value so as to find the gel strength of the gelled mud.

A further aspect is the possibility of determining the yield strength and the compressibility of the gelled mud from the rising part of the pressure peak. When the drilling tool starts rotating if the evolution of the fluid pressure is monitored with regard to the quantity of pumped fluid, two values of the physical properties can be obtained: one dynamic when the drilling tool is rotating and the other static when the drilling tool is stationary.

A yet further aspect is the possibility of determining the asymptotic value of the down curve of the pressure peak. From this asymptotic value, the pressure drop due to fluid loss in the well can be determined. The operation can be repeated to follow the evolution of the pressure of the fluid being pumped compared to the quantity of fluid being pumped after the fluid has been stationary for a relatively constant period of time. This operation can be repeated almost every time that a drill pipe is added. The successive evolutions of the pressure can be compared and the variations of the physical properties characteristic to the thixotropy of the drilling fluid can be found.

The invention will be better understood when reading the following description and the attached figures.

FIG. 1 shows a sketch of a well being drilled and the surface equipment used for circulating and cleaning the drilling fluid.

FIG. 2*a* shows a rheogram of the mud i.e. the shear stress ST, the shear rate SR and FIG. 2*b* represents the evolution of pressure p of the fluid being pumped in relation to the volume of the pumped fluid for different levels of mud gelation.

Figure 1:
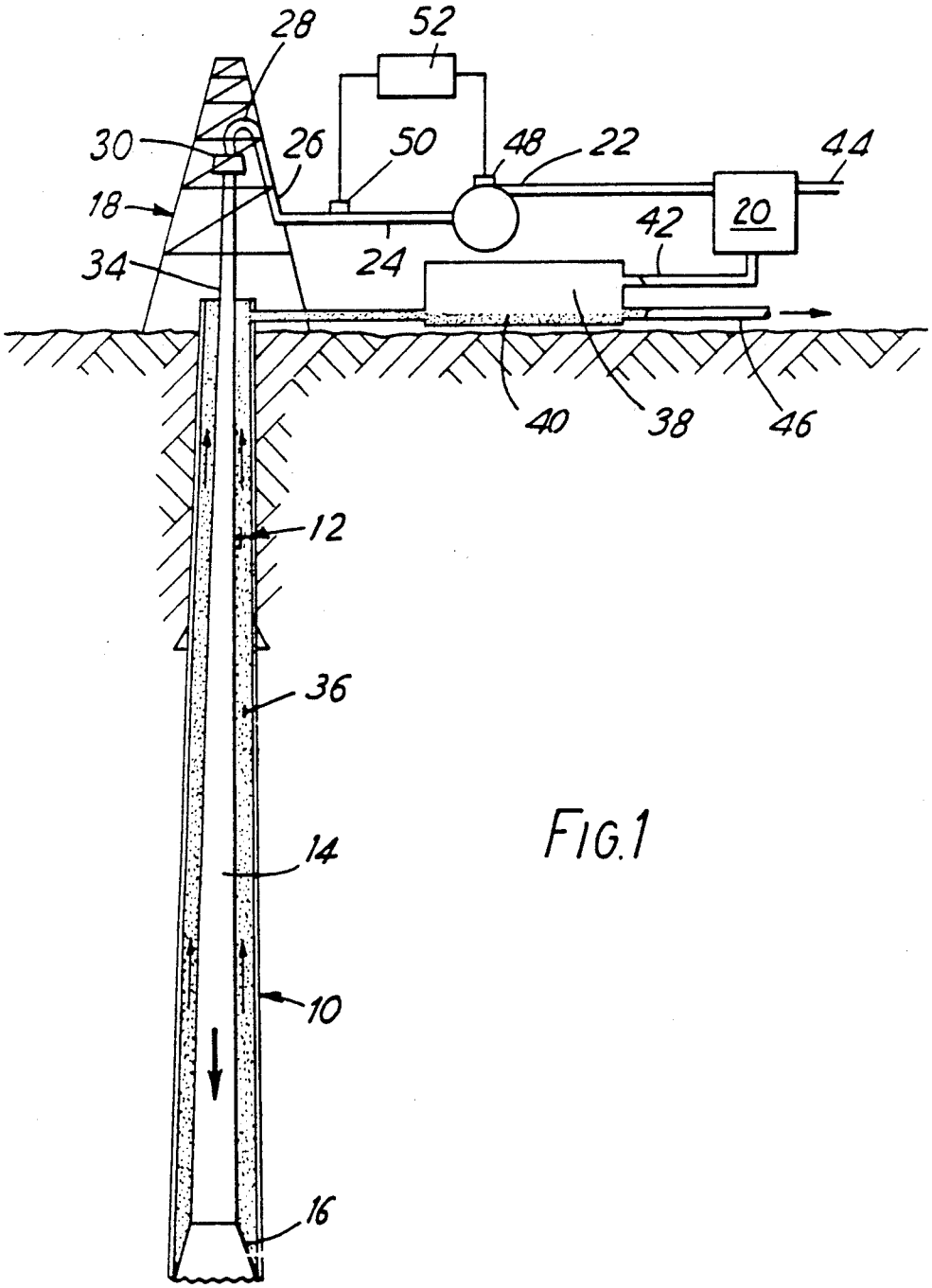

FIG. 1 shows a schematic of a drilling well (10) with a drill string (12) including drill pipes (14) and a drill bit (16). A drilling tower (18) allows handling of the drill string from the surface, particularly to add pipes to the drill string and to start rotating the drill string (16) to drill the rock. The drill bit rotation can also be carried out with a motor situated at the bottom, particularly when drilling deviated wells.

Every time the well is drilled for an additional depth of a pipe length, about 9 meters, a new pipe is added to the top end of the drill string on the surface. The drilling of the well will start again until another length of pipe is drilled. This is done again until the drill string is removed from the well either because the drill bit is worn or because the desired depth has been reached. A drilling fluid generally called "mud" is kept in a mud tank (20). This fluid is circulated by a pump (22). The fluid passes up a rigid pipe (24), then a stand pipe (26) before being sent in the drill string from an injection head (30) connected to the stand pipe (26) by a flexible pipe (28). The first pipe (34) connected to the injection head (30) has a square section so that it can be rotated from a rotating table (not shown). The drill pipes added one after the other during drilling operations are fitted between the square pipe (34) and the drill string (12).

The drilling fluid circulates inside the drill string (12), then through the drill bit (16) via the injectors up to the surface in the annular space (36) existing between the drill string and the wall of the well (10). At the surface, mud goes through a cleaning process (38) in which the cuttings (40) are separated from the mud which then returns through pipe 42 in the mud tank 20. New mud and/or adjuvants can be added in the tank through pipe 44. The cuttings 40 are sent through the pipe 46. The pumping equipment includes a sensor 48 recording pump cycles 22. Each pump cycle corresponds to a certain volume of fluid pumped in pipe 24. The number of cycles allows the determination of the volume of fluid pumped inside the drill string. A flow rate valve placed inside pipe 24 could be used instead of sensor 48 to measure the volume of fluid pumped inside the drill string. A pressure sensor situated between pump 22 and the injection head measures the pressure of the fluid pumped inside the column. Sensors 48 and 50 are connected to a data recorder 52. This recorder allows, for example, real time recording of the evolution of the pressure measured by sensor 50, as well as the number of pump strokes detected by sensor 48. This recorder also allows to measure the evolution of the pressure related to the number of pump cycles. One of the main functions of drilling mud is to carry the cuttings produced by drill bit from the bottom of the well to the surface through the annular space 36. Every time a drill pipe is added to the drill string 40, pump 22 is stopped and circulation of the mud is also stopped. When the mud is stationery, the cuttings present in the annular space have a tendency to fall to the bottom of the well. In order to prevent such an inconvenience, a relatively viscous drilling fluid is used to maintain the cuttings in suspension when the fluid is stationery. However, the viscosity of the mud cannot be too great from the pumping means to circulate the mud effectively in the well. This is achieved by using a thixotropic drilling fluid, that is to say, a fluid in which the viscosity decreases when the fluid is placed in rotation or agitated. It is current practice in order to find the fluid behavior to trace a rheogram showing the shear stress ST as opposed to the shear rate SR applied to the fluid. This behavior is shown on FIG. 2*a*. For this, a viscosimeter is used to submit the fluid being tested to a given shear rate and record the shear stress. The viscosimeter most often used in the Petroleum Industry is the FANN viscosimeter. It has two coaxial cylinders between which is placed a mud sample to be tested. The mud shear stress is obtained by rotating one cylinder against the other, the shear stress is then defined by the strength necessary to apply to the other cylinder to stop rotation. Another type of viscosimeter is made of a narrow tube in which a mud sample circulates. The pressure difference is recorded (p1−p2) between the entry and exit of the fluid in and out of the viscosimeter as a function of flow rate Q. For this type of viscosimeter, the shear stress is given by:

$$ST = D(p1 - p2)/4L$$

D and L being respectively the diameter and the length of the viscosimeter.

The shear rate SR is given by:

$$SR = 32Q/3.14D^3$$

The rheogram on FIG. 2 of the shear stress ST of the shear rate SR is equivalent to a diagram showing the variation of the fluid pressure in relation to flow rate Q, knowing the shape of the tube in which the fluid circulates.

Figure 2A:
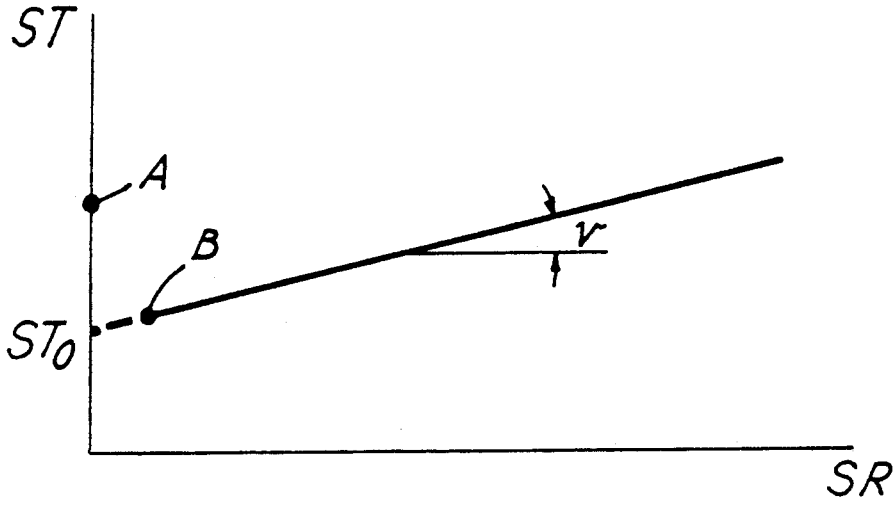

The rheogram on FIG. 2 is typical of a non-newtonian fluid; to activate this fluid it is necessary to submit it to a minimum shear stress $ST_0$, called yield stress. With a shear stress higher than $ST_0$, the fluid is circulating. The slope of the curve ST compared to SR is, by definition, the apparent viscosity of the fluid. However for thixotropic fluids such as drilling mud which have a tendency to gel when stationary, the shear rate ST necessary to activate the fluid is higher than the yield stress $ST_0$. This shear stress, called gel strength is indicated by point A on the rheogram of FIG. 2*a*. When the gel strength of the gelled fluid is reached, the shear stress decreases rapidly down to point B to follow the curve shown on FIG. 2*a*.

In this invention, when the circulation of the fluid is started again with the pumping unit, the evolution of the pressure of the fluid pumped in the drill string in relation to the number of pump cycles can be clearly seen, taking into account the volume of the fluid pumped in the drill string and with the drilling fluid being stationary at the beginning of the experiment. The pressure curve reaches a maximum at gel breaking point i.e. at gel strength of the gelled fluid. This defines the physical property of the thixotropy of a drilling fluid. In good conditions, this pressure test is carried out after having added a pipe to the drill string when circulating by pumping is resumed. If this test is carried out regularly and if the period during which the fluid remains stationary is kept constant, it is possible to follow the evolution of the physical property of the drilling fluid thixotropy and particularly the evolution of the gel strength gelled during its life in the well.

Figure 2B:
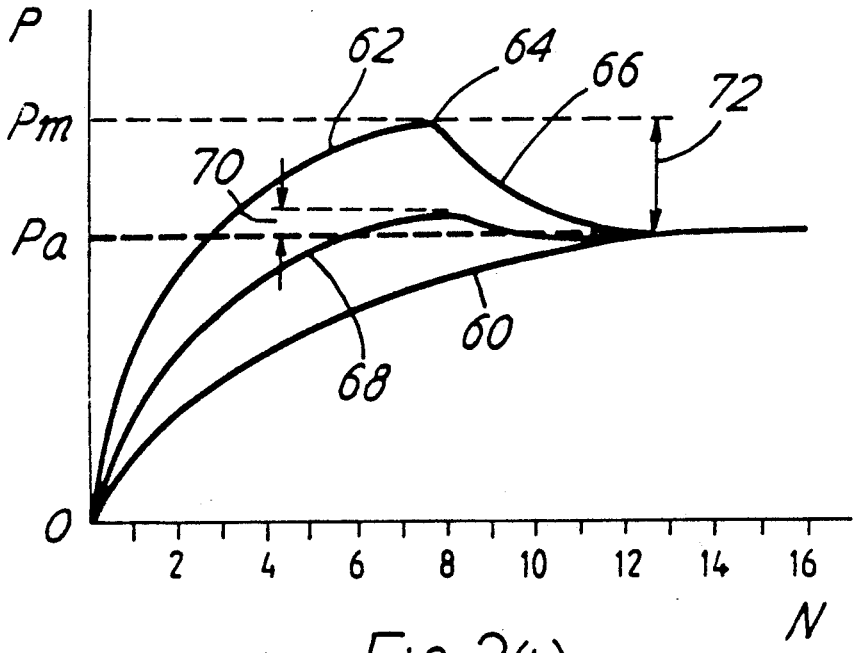

Fig. 2*b* shows the evolution of the fluid pressure measured by sensor 50 from the number of pump cycles of pump N measured by sensor 48 with the the fluid being stationary. The curve 60 shows the evolution of the pressure for a non-gelled fluid. The curve reaches its asymptotic value $p_a$ showing the pressure drop in the drill string and in the annulus corresponding to the smallest flow rate of the fluid. The curve 62 shows the evolution of the pressure related to the number of pump strokes N, for a gelled fluid and resuming of circulation. The drill string is stationary. The pressure reaches a peak 64 when the number of pump strokes is equal to 8 when a certain amount of fluid is injected in the drill string. Before reaching this peak, i.e. n=8, the gelled fluid is stationary. When maximum pressure is reached, the gel breaks and pressure drops rapidly (curve 66) to reach the asymptotic value $p_a$. The highest pressure $p_m$ corresponds to the gel strength of the gelled fluid. The maximum value varies from the degree of gelation of the gel which increases rapidly when circulation of the fluid stops to reach a stabilised value after a while. To compare the gel strength of two types of fluids or to follow the evolution of the gel strength of a gelled fluid during its utilization, the successive pressure tests (curve 62, FIG. 2*b*) must be done while the fluid is stationary during a relatively constant period of time before each test. The rising part between N=0 and N=8 shows the elasticity and compressibility of the gelled fluid. Curve 68 shows the evolution of the pressure for the same gelled fluid as in curve 62 but the drill string is rotating at more or less constant speed. If the rotation speed of the drill string is fairly low, and the fluid inside the drill string is considered as turning together with the drill string when the fluid in the annulus is agitated, the gel in the annulus is broken. The difference in the pressure indicated in 70 on FIG. 2*b* is then the gel strength of the gelled fluid in the drill string. The difference of pressure $p_m - p_a$, indicated in 72, indicates the static gel strength of the gelled fluid in the drill string and in the annulus. The following figures illustrate the invention with measurements taken during drilling operations. The diagram of FIGS. 3 and 5 were recorded as per time and indicated in seconds. The pump is started again at time $t_0$ at slow speed with a small flow. From time $t_1$ the number of pump strokes increases.

Figures 3A, 3B, 3C:
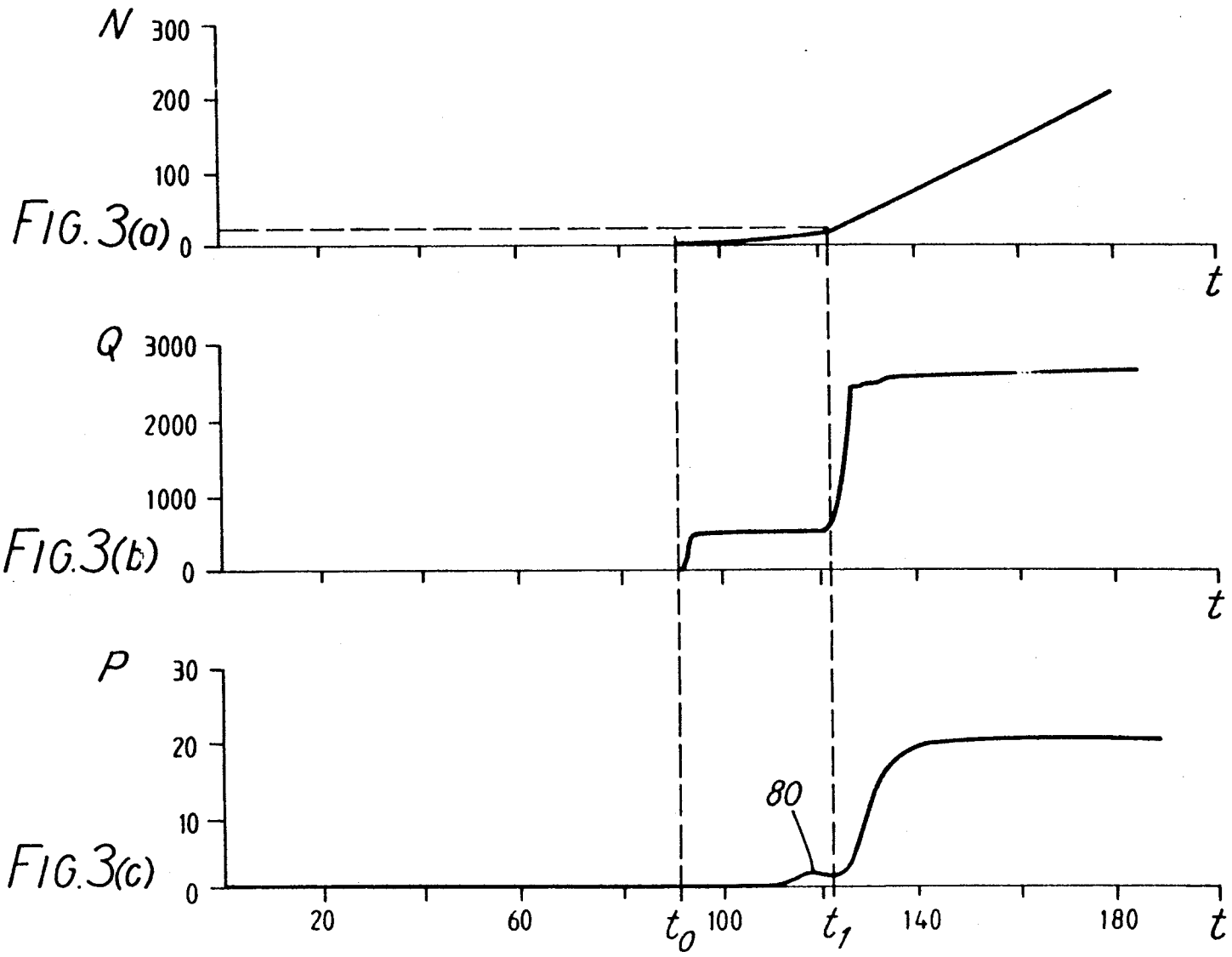
FIG. 3 shows three diagrams, in terms of time, the number of pump cycles N, the flow rate Q and the pressure p of the pumped fluid when the drill pipe is being added.

FIG. 3*b*, which shows the flow Q in relation to time, is no less than the integral of the number of pump cycles of FIG. 3*a* in relation to time. The flow is indicated in liters per minute. Between time $t_0$ and $t_1$, the flow Q is small and constant. It increases rapidly at time $t_1$ to reach stabilisation at a relatively constant value. On FIG. 3*c*, it can be seen that pressure p, indicated in MPa goes to a maximum 80 between time $t_0$ and $t_1$. This maximum 80 is the yield point of the gelled fluid. Pressure then rises rapidly to stabilise at a relatively constant value.

Figure 4:
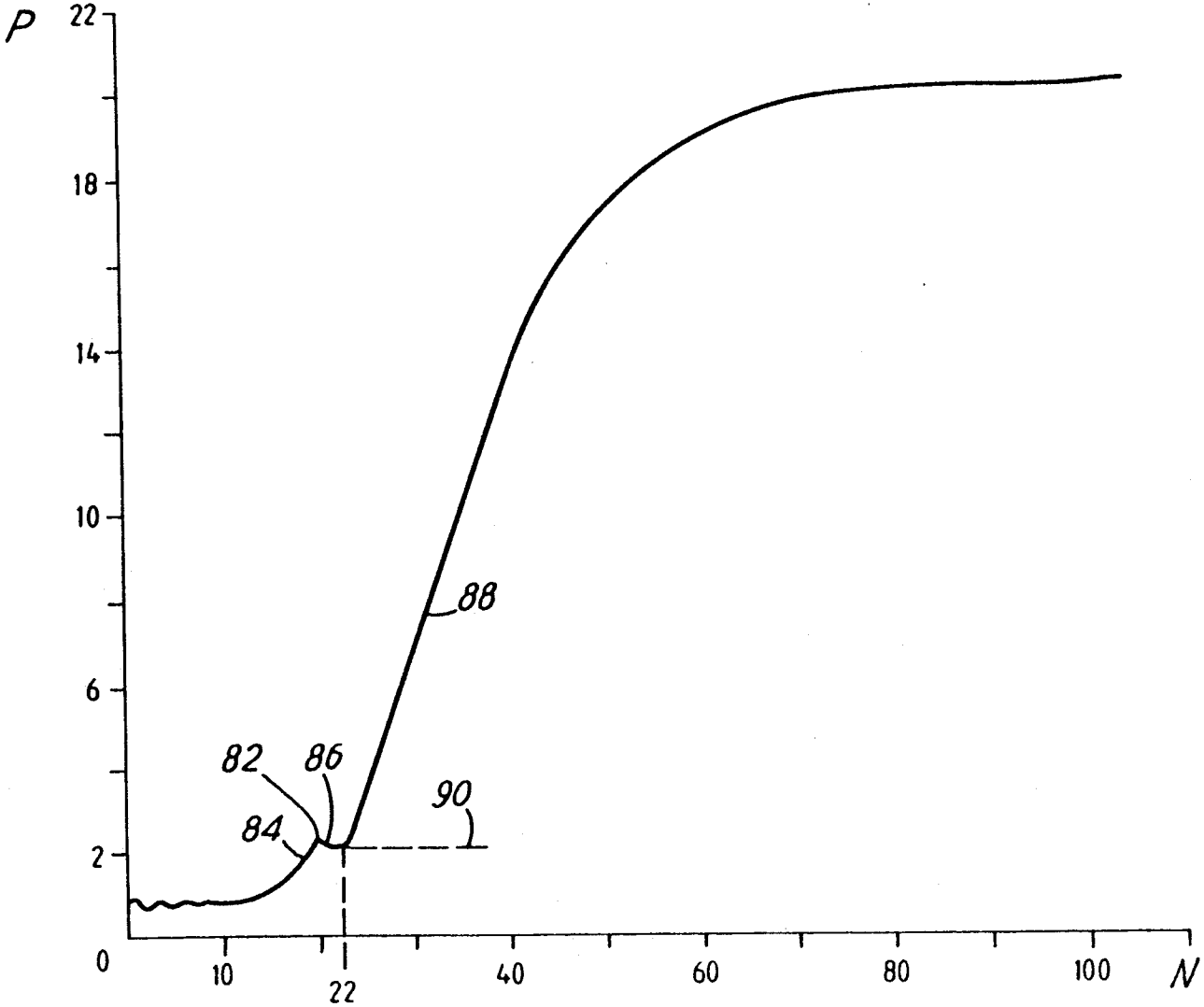
FIG. 4 shows the evolution of pressure p of the pumped fluid in relation to the number of pump cycles, drawn from FIGS. 3*a* and *c*.

FIG. 4 shows the evolution of the pressure p of the pumped fluid related to the number of pump cycles N. The curve was made by combining FIGS. 3*a* and 3*c*. Pressure is relatively stable around 1 MPa, until a number of pump cycles of around 10. This number of pump cycles corresponds to the volume of fluid necessary to inject in the drill string to compress the air sent in the drill string when a pipe is added. A pressure peak 82 happens, shown by a rapid increase of pressure 84 followed by a drop 86 until a number of pump cycles of 22. Then, pressure increases rapidly (part of curve 88) until it stabilises. The maximum 82 of the pressure peak corresponds to the breaking point of the gelled fluid or its gel strength. As long as maximum 82 of the pressure has not been reached, the fluid remains stationary in the well. It only starts circulating again when maximum 82 is reached. If the driller had not increased the pumps flow from the number of cycles N=22, the pressure drop 86 would have stabilised until reaching a plateau 90.

The data on FIG. 5 were recorded during the same well as FIG. 3, and with the same type of drilling fluid, but two and a half hours later. FIGS. 5*a*, *b* and *c* show respectively the number of pump cycles N, the flow Q in liters per minute and the pressure p in MPa, recorded as per time t. The pump is restarted at time to. On FIG. 5*b* the successive flow rate in seconds are indicated between time $t_0$, $t_1$, $t_2$ and $t_3$. On FIG. 5*c*, a pressure peak 92 appears at time $t_0$.

Figures 5A, 5B, 5C:
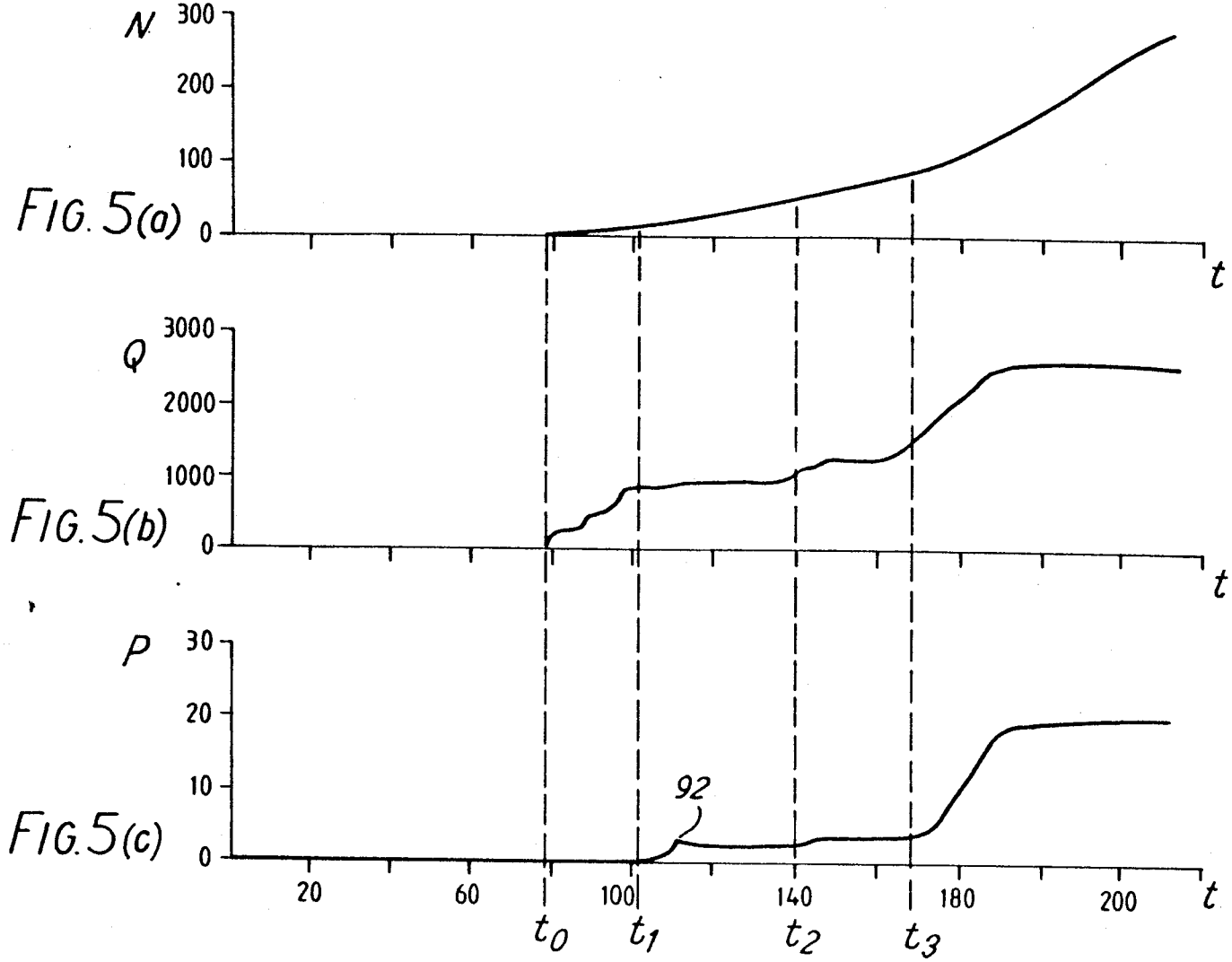
FIG. 5 (including parts 5*a*–5*c*) shows the same date as FIG. 3 but recorded two and a half hour later.
Figure 6:
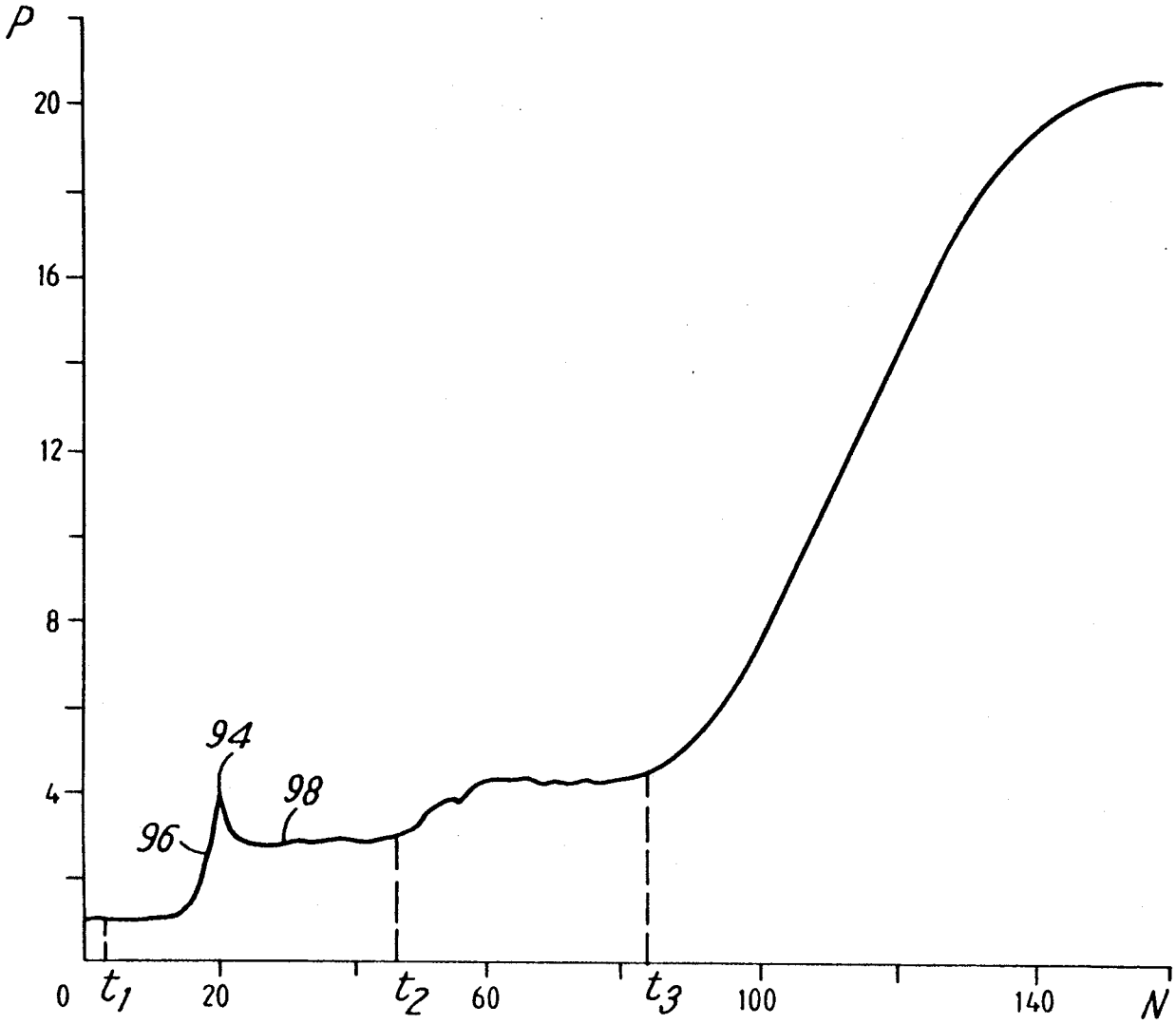
FIG. 6 shows the evolution of pressure p in relation to the number of pump cycles N drawn from FIGS. 5*a* and *c*.

The curve on FIG. 6 showing the evolution of the pressure in relation to the number of pump cycles was done by combining the FIG. 5*a* and 5*c* curves. On FIG. 6, pressure is relatively constant, at 1 MPa, until the number of pump cycles equals to 15. This part of the curve shows the air being compressed in the drill string. The pressure then increases rapidly, curve 96, until a maximum value of 4 MPa for a number of pump cycles equal to 20. This rise in pressure indicates the elasticity and compressibility of the gelled fluid. The maximum of the pressure, indicated in 94, is the gel breaking point and the moment from which the fluid is recirculated in the well.

The pressure then drops to an asymptotic value of approximately 3 MPa. The difference between maximum value of 4 MPa and the asymptotic value of 3 MPa is the static gel strength of the fluid gelled at 1 MPa. Between time $t_2$ and $t_3$, the pump flow is changeable. After time $t_3$, pressure increases rapidly.

The comparison between pressure peaks 82 (FIG. 4) and 94 (FIG. 6) allows the definition of the changes of the thixotropic properties of the drilling fluid in relation to time. The peak maximum values allow the comparison of the different gel strengths of the gelled fluids, the asymptotic values (90 on FIG. 4 and 98 on FIG. 6) allow the comparison of the loss of fluid in the well and the differences between the peak maximum values and the asymtotic values allows the definition of the changes in the static gel strength of the gelled fluid. The pressure rises shown at 84 on FIG. 4 and 96 on FIG. 6 allow the evolution of the elasticity and compressibility of the gelled fluid to be followed.

The found values, such as the gel strength of the gelled fluid can be compared one against the other but can also be compared against a predetermined value. If, for example, the gel strength of the gelled mud must not exceed a set value, and if the measurements done with this invention show that the value has been exceeded, or is going to be exceeded, the mud formula can be modified to bring the mud properties to the planned specifications. If necessary, changes can be made to allow for the increase in the drill string length as pipes are gradually added.

I claim:

1. A method of in situ testing of a thixotropic drilling fluid used during the drilling of a well, said drilling comprising using a drill string assembly including a drill bit, and drill pipes joined together and said drilling fluid which is being either stationary in which state it has a tendency to gel or is circulated by means of a pumping unit from the surface to the drill bit inside the drill string and rising to the surface through an annular space defined between a wall of the well already drilled and the drill string; the method comprising monitoring of such fluid in a stationery state for a period of time after which circulation of the drilling fluid is restarted and the evolution of the pressure of the fluid pumped in the drill string is followed with regard to the volume of the fluid being pumped and the physical property of the thixotropy of the fluid is defined.

2. A method as claimed in claim 1, wherein a pressure peak occurring when the fluid circulation in the well is restarted is observed and used to define property.

3. A method as claimed in claim 2, wherein the maximum value of the pressure peak is measured and a characteristic value of the gel strength of the gelled fluid is determined therefrom.

4. A method as claimed in claim 2, wherein the characteristic value of the gelled fluid elasticity is defined from a rising part of the pressure peak.

5. A method as claimed in claim 2, wherein a asymptotic value of a decreasing part of the pressure peak is defined.

6. A method as claimed in claim 5, wherein loss of fluid due to leakage in the well is determined from the asymptotic value.

7. A method as claimed in claim 5, wherein the static value of the fluid gel strength is determined by subtracting the asymptotic value from the maximum pressure peak value.

8. A method as claimed in claim 1, wherein the evolution of the fluid pressure with regard to the volume of fluid being pumped when the drill string is stationary and when it is rotating is monitored so as to find the values of the fluid physical property, a dynamic value when the drill string is rotating and a static value when the drill string is stationary.

9. A method as claimed in claim 8, wherein the difference between the static and the dynamic values is determined.

10. A method as claimed in claim 9, wherein the gel strength of the fluid in the annular space is defined from the difference between the dynamic and static values.

11. A method as claimed in claim 8, wherein the rotation speed of the drill string is set so that the drilling fluid inside the drill string circulates together with the drill string and that the drilling fluid inside the annular space is circulated to stop the gelation of the fluid.

12. A method as claimed in claim 1, wherein the operation of following the evolution of the pressure of the pumped fluid with regard to its volume after the fluid has been stationary during a relatively constant period of time is repeated regularly after having added a drill pipe so as to define the changes in the physical property linked to the thixotropy of the drilling fluid.

13. A method as claimed in claim 12, wherein the drilling fluid formula is adjusted when the above changes in the physical property rise above a set value.

* * * * *